US009022506B2

(12) United States Patent
Asada

(10) Patent No.: US 9,022,506 B2
(45) Date of Patent: May 5, 2015

(54) PRINT CONTROL DEVICE, PRINT CONTROL METHOD, AND PRINT CONTROL PROGRAM

(71) Applicant: Seiko Epson Corporation, Tokyo (JP)

(72) Inventor: Tatsuya Asada, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/082,078

(22) Filed: Nov. 15, 2013

(65) Prior Publication Data

US 2014/0139574 A1 May 22, 2014

(30) Foreign Application Priority Data

Nov. 19, 2012 (JP) ..... 2012-252968

(51) Int. Cl.
*B41J 2/205* (2006.01)
*B41J 2/21* (2006.01)
*B41J 2/165* (2006.01)

(52) U.S. Cl.
CPC ..... *B41J 2/2107* (2013.01); *B41J 2/165* (2013.01)

(58) Field of Classification Search
CPC ..... B41J 11/008; B41J 2/2056; B41J 2/2107; B41J 2/04508; B41J 2/21
USPC ..... 347/9, 12, 14, 15, 40–43
See application file for complete search history.

(56) References Cited

U.S. PATENT DOCUMENTS

| | | | |
|---|---|---|---|
| 2008/0137147 | A1 | 6/2008 | Nakano et al. |
| 2010/0309243 | A1 | 12/2010 | Nakano et al. |
| 2012/0139980 | A1 | 6/2012 | Ishihara |

FOREIGN PATENT DOCUMENTS

| | | | |
|---|---|---|---|
| JP | 2008-162258 | A | 7/2008 |
| JP | 2009-269321 | A | 11/2009 |
| JP | 2010-184415 | A | 8/2010 |
| JP | 2012-101516 | A | 5/2012 |

*Primary Examiner* — An Do
(74) *Attorney, Agent, or Firm* — Kilpartick Townsend & Stockton LLP

(57) ABSTRACT

In a print control device which prints a monochrome image by discharge of a black ink from a nozzle for discharging an ink, a chromatic color ink in addition to the black ink is discharged in a region where an amount of use of the black ink indicated by monochrome image data representing the monochrome image, is equal to or higher than a predetermined threshold value. In the region, chromatic color inks of different colors are discharged to positions which do not overlap with each other.

8 Claims, 9 Drawing Sheets

FIG. 5

| | | | | | |
|---|---|---|---|---|---|
| 1 | 0 | 0 | 0 | 0 | 0 |
| 0 | 1 | 0 | 0 | 0 | 0 |
| 0 | 0 | 1 | 0 | 0 | 0 |
| 0 | 0 | 0 | 1 | 0 | 0 |
| 0 | 0 | 0 | 0 | 1 | 0 |
| 0 | 0 | 0 | 0 | 0 | 1 |

M1

| | | | | | |
|---|---|---|---|---|---|
| 0 | 1 | 0 | 0 | 0 | 0 |
| 0 | 0 | 1 | 0 | 0 | 0 |
| 0 | 0 | 0 | 1 | 0 | 0 |
| 0 | 0 | 0 | 0 | 1 | 0 |
| 0 | 0 | 0 | 0 | 0 | 1 |
| 1 | 0 | 0 | 0 | 0 | 0 |

M2

| | | | | | |
|---|---|---|---|---|---|
| 0 | 0 | 1 | 0 | 0 | 0 |
| 0 | 0 | 0 | 1 | 0 | 0 |
| 0 | 0 | 0 | 0 | 1 | 0 |
| 0 | 0 | 0 | 0 | 0 | 1 |
| 1 | 0 | 0 | 0 | 0 | 0 |
| 0 | 1 | 0 | 0 | 0 | 0 |

M3

PATH 1
PATH 2
PATH 3
PATH 4
PATH 5
PATH 6
62
62a
62b
K Y
K M K Y
K C K M K Y
K C K M K Y
K C

PRINT CONTROL DEVICE, PRINT CONTROL METHOD, AND PRINT CONTROL PROGRAM

BACKGROUND

1. Technical Field

The present invention relates to a print control device, a print control method, and a print control program.

2. Related Art

A printer which discharges an ink from a nozzle for discharging an ink and performs a printing has been known. Such a printer discharges each ink such as black, cyan, magenta, yellow, and the like from each nozzle corresponding to respective inks. However, not every ink is always used in a printing, and monochrome printing is also performed where black ink only is used. In such a case, nozzles corresponding to inks other than a black ink are plugged by ink around the nozzles, which is dried and has increased viscosity since the frequency of use of the nozzle is low.

As a solution to the plugged nozzles, an image processing method that forms the image using a black ink and forms dots of the black ink and each color ink at the same position when an input image is in black has been known (refer to JP-A-2009-269321 and JP-A-2008-162258). In addition, an image forming apparatus has been known which has an ink usage adjustment unit adjusting the amount of use of the black ink and color inks and an image drawing unit drawing a monochrome image on a recording medium using the adjusted ink, and in which the ink usage adjustment unit adjusts the amount of use of each ink based on property of each ink to be used (drying characteristic of an ink) and a use environment (temperature, humidity, area, type of recording medium) so as not to get the nozzles plugged by drying of each ink (refer to JP-A-2010-184415).

As in each document described above, when a black ink and a color ink are used in printing a monochrome image, the influence of the color ink may cause an adverse effect that a density of black color of a printed result (referred to as an optical density (OD) value) is lower than a value originally expected and the printed result is in a gray color. In addition, as in JP-A-2009-269321 and JP-A-2008-162258 described above, a method of forming dots of color inks of different colors at the same position, when a positional deviation occurs between the dots to be formed at the same position due to transport accuracy of a print medium, positional accuracy of a print head and a nozzle, and the like, has blurring of an outline of the image and a hue deviation, thereby causing an image quality to be decreased.

SUMMARY

An advantage of some aspects of the invention is to provide a technology which can reduce plugging of a nozzle and prevent a decrease in an image quality.

According to an aspect of the invention, there is provided a print control device which causes a monochrome image to be printed by discharge of a black ink from a nozzle for discharging an ink, and which discharges a chromatic color ink in addition to the black ink in a region where the amount of use of the black ink is indicated by the monochrome image data representing the monochrome image is equal to or higher than a threshold value.

In this configuration, the print control device can discharge the chromatic color ink in addition to the black ink only in a region where the amount of use of the black ink indicated by the monochrome image data is equal to or higher than the threshold value. Therefore, it is possible to substantially eliminate the effect of the chromatic color ink on the image quality of a print result of the monochrome image, and to reduce the plugging of a nozzle corresponding to the chromatic color ink.

In the print control device according to the aspect, the print control device may discharge chromatic color inks of different colors to positions which are not overlapped each other.

In this configuration, with respect to the above-describe region, dots of black ink do not overlap with a plurality of dots of the chromatic color inks of different colors in the print result. Therefore, the decrease in OD value, blurring of outlines, and a deviation of the hue in the print result are suppressed, so that the image quality may be prevented from being lowered.

In the print control device according to the aspect, the print control device may have the threshold value varying with respect to at least some colors among the chromatic color inks of different colors.

In this configuration, when using a plurality of types of chromatic color inks, the amount of use of the black ink which may allow discharge of the black ink and the chromatic color ink varies according to a color of the chromatic color ink. Therefore, it is possible to set the threshold value according to the intensity of an effect of each chromatic color ink on an appearance of the print result, and to accurately suppress a decrease in the image quality.

The intensity of the effect of each chromatic color ink on the appearance of the print result correlates with level of brightness of each chromatic color ink. In the print control device according to the aspect, the higher a brightness value of the chromatic color ink is, the lower the threshold value is.

In this configuration, the chromatic color ink where brightness is relatively high is discharged with the black ink in a region where the amount of use of the black ink is relatively low, and on the other hand, a chromatic color ink where brightness is low is discharged with the black ink in a region where the amount of use of the black ink is relatively high. Therefore, it is possible to ensure the image quality and to suppress the plugging of a nozzle in a good balance.

In the print control device according to the aspect, the chromatic color ink may be discharged prior to the black ink in the region.

In this configuration, when the chromatic color ink and the black ink are discharged to a certain region, the chromatic color ink is discharged first, and the black ink is discharged thereon. Therefore, it is possible to reduce more the effect of the chromatic color ink on the image quality of the print result of the monochrome image.

In the print control device according to the aspect, after discharging the black ink in a region where the amount of use of the black ink indicated by the monochrome image data does not reach the threshold value, cleaning processing may be performed which discharges a chromatic color ink to a position deviated from the print medium.

In this configuration, with respect to a region where the amount of use of the black ink is lower than the threshold value, the chromatic color ink is not discharged, but the cleaning processing is performed outside the print medium. Therefore, it is possible to avoid both a decrease in the image quality of the printed monochrome image and the plugging of a nozzle.

The technical concepts of the invention may be not only realized in a form of a print control device, but also embodied in other objects (devices). In addition, it is possible to understand the invention of a method (print control method) which includes a processing step corresponding to the features of the print control device according to any of the aspects described above, the invention of a print control program which causes a predetermined hardware (computer) to perform the method, and an invention of a computer-readable recording medium which records the program. In addition, the print control device may be realized by a single device, and may be realized by a combination of a plurality of devices. Additionally, a print control device may be realized by a single printing apparatus (printer) having a nozzle and a print head.

BRIEF DESCRIPTION OF THE DRAWINGS

The invention will be described with reference to the accompanying drawings, wherein like numbers reference like elements.

FIG. 5 is a diagram showing an example of a mask for disposing a color dot.

DESCRIPTION OF EXEMPLARY EMBODIMENTS

The following describes an embodiment of the invention with reference to drawings.

1. OUTLINE OF DEVICE

Figure 1:
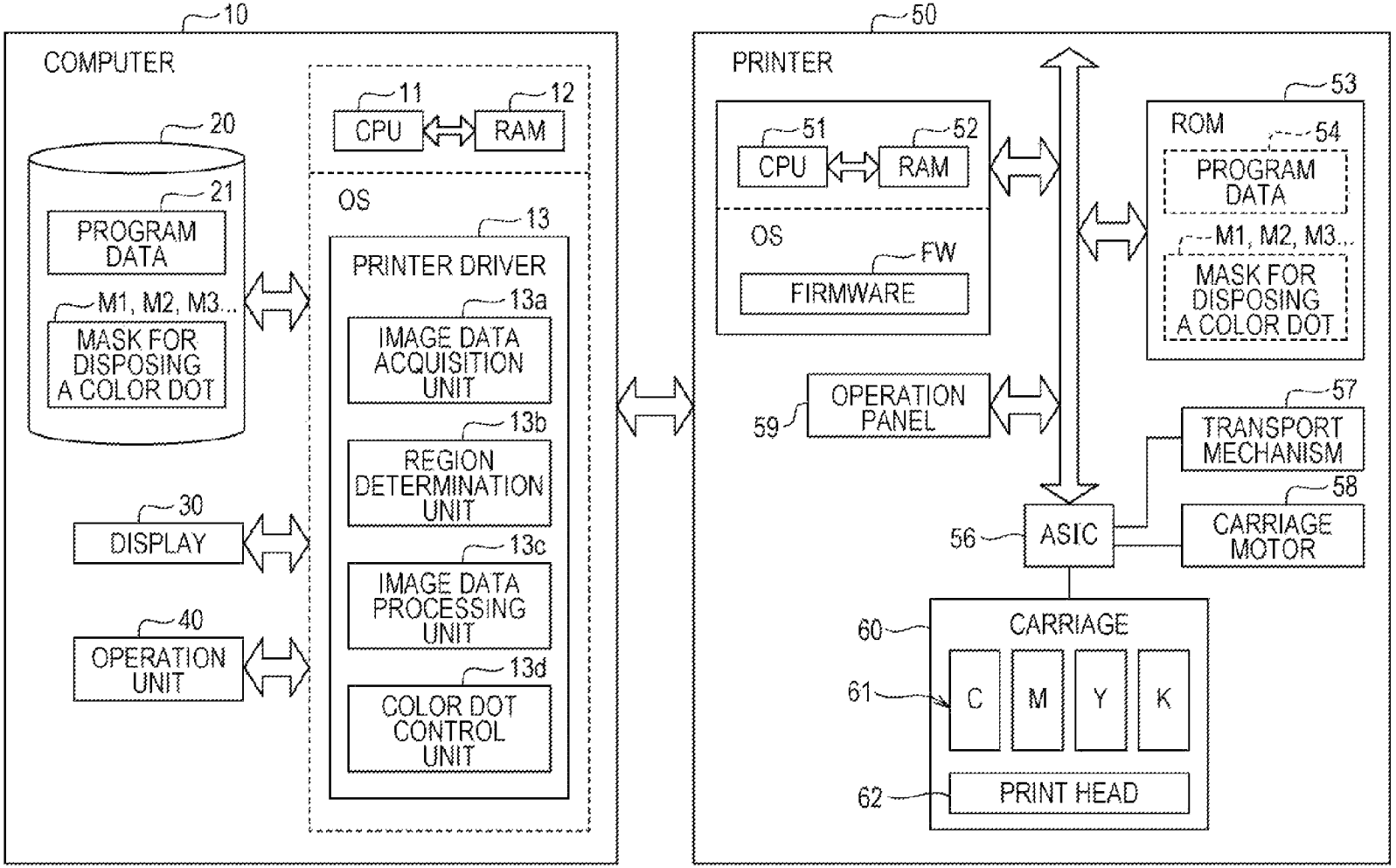
FIG. 1 is a diagram showing hardware and software configurations.

FIG. 1 schematically shows hardware and software configurations according to the embodiment. FIG. 1 indicates a computer 10 as a personal computer (PC) and a printer 50. The computer 10 and/or the printer 50 are print control devices. In addition, the computer 10 and the printer 50 configure one print system 1. In the computer 10, a CPU 11 expands program data 21 stored in a hard disk drive (HDD) 20 and the like to a RAM 12 and performs a calculation according to the program data 21 under the OS, and thereby performs a printer driver 13 for controlling the printer 50. The printer driver 13 is a program to perform each function of an image data acquisition unit 13*a*, a region determination unit 13*b*, an image data processing unit 13*c*, a color dot control unit 13*d*, and the like in the CPU 11. Each function of these will be described below.

A display 30 as a display unit is connected to the computer 10, and a user interface (UI) screen which is necessary for each processing is displayed on the display 30. In addition, the computer 10 appropriately includes an operation unit 40 which is realized by, for example, a keyboard, a mouse, a touch pad, a touch panel, or the like, and an instruction necessary for each processing is input through the operation unit 40 by a user. In addition, the printer 50 is connected to the computer 10. As described below, in the computer 10, a print command is generated by a function of the printer driver 13 based on image data where an image to be printed is represented, and a print command is sent to the printer 50.

In the printer 50, a CPU 51 expands program data 54 stored in a memory such as a ROM 53 and the like to a RAM 52 and performs a calculation according to the program data 54 under the OS, and thereby performs firmware FW for controlling the device itself. The firmware FW interprets the print command sent from the computer 10 to extract print data and send the print data to ASIC56, and thereby it is possible to perform printing based on the print data. In addition, the firmware FW can acquire image data where an image to be printed is represented from a memory card mounted on the connector for external connection which is not shown and an external device (for example, the computer 10), and the like, and generate print data based on the acquired image data. Even when the print data are generated by the function of the firmware FW, the print data are sent to the ASIC56.

The ASIC56 acquires the print data and generates a driving signal for driving a transport mechanism 57, a carriage motor 58, and a print head 62 based on the print data. The printer 50 includes a carriage 60, and the carriage 60 is equipped with an ink cartridge 61 for each of a plurality of ink types. In an example of FIG. 1, the ink cartridges 61 corresponding to various types of ink such as cyan (C), magenta (M), yellow (Y), and black (K) are equipped.

A specific type and a number of inks which are used by the printer 50 are not limited to those described above, and various inks may be used such as, for example, light cyan, light magenta, orange, green, gray, light gray, white, metallic ink, and the like. In addition, the ink cartridge 61 may be installed at a predetermined position in the printer 50 not equipped in the carriage 60. The carriage 60 includes the print head 62 ejecting (discharging) an ink supplied from each ink cartridge 61 from a plurality of nozzles for discharging an ink.

Figure 2:
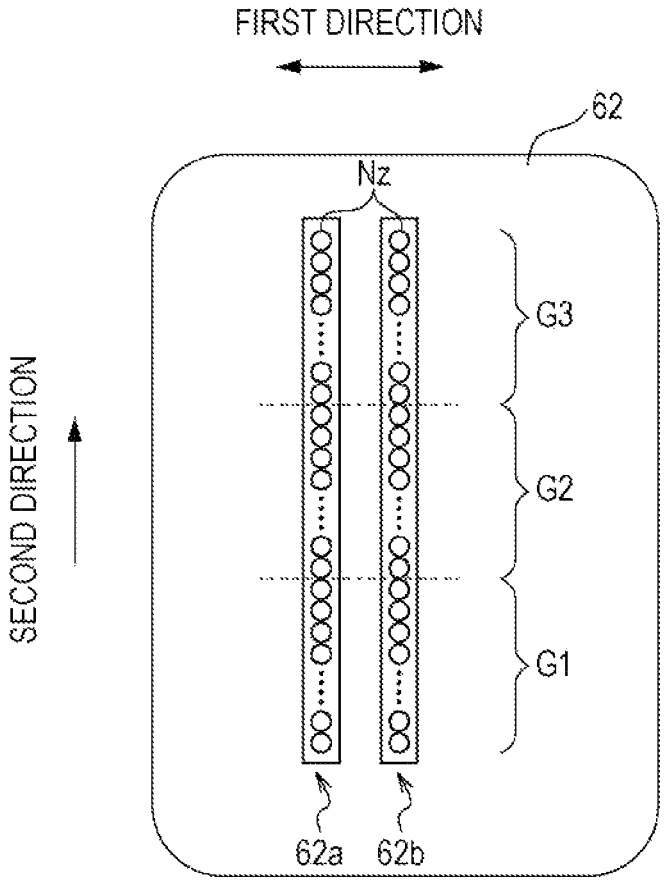
FIG. 2 is a diagram showing an example of an array of print head nozzles.

FIG. 2 shows an example of an arrangement of nozzles at a lower surface (a surface facing a print medium) of the print head 62. At the lower surface of the print head 62, a K nozzle row 62*a* formed of a plurality of nozzles Nz (K nozzle) for discharging a K ink and a chromatic nozzle row 62*b* formed of a plurality of nozzles Nz for discharging C, M, and Y inks as a chromatic color ink are formed. The K nozzle row 62*a* and the chromatic nozzle row 62*b* are parallel to each other, and each is configured to have a plurality of nozzles Nz aligned along a second direction (refer to FIG. 2) substantially perpendicular to a first direction. The first direction is a main scanning direction of the print head 62, and the second direction is a transport direction of the print medium in the printer 50. In addition, the second direction is referred to as a sub-scanning direction.

A density (the number of nozzles/inch) of nozzles Nz in each of the K nozzle row 62*a* and the chromatic nozzle row 62*b*, for example, is equal to print resolution (dpi) in the sub-scanning direction by the printer 50. The K nozzle row 62*a* and the chromatic nozzle row 62*b* may be not only configured to only have one row of nozzles aligned along the sub-scanning direction, but also configured to have a plurality of rows of nozzles which are parallel to each other and deviated at a predetermined pitch in the sub-scanning direction. Furthermore, the chromatic nozzle row 62*b* includes a nozzle row (C nozzle row) formed of a plurality of nozzles Nz (C nozzles) for discharging the C ink, a nozzle row (M nozzle row) formed of a plurality of nozzles Nz (M nozzles) for discharging the M ink, and a nozzle row (Y nozzle row) formed of a plurality of nozzles Nz (Y nozzles) for discharging the Y ink. In other words, the C nozzle row, the M nozzle row, and the Y nozzle row are formed to be deviated from each other in a tangential direction thereof, and thereby configure the chromatic nozzle row 62*b* as a whole. The C nozzle row, the M nozzle row, and the Y nozzle row have the same number of nozzles Nz, respectively.

Furthermore, each of the C nozzle row, the M nozzle row, and the Y nozzle row is a part of the K nozzle row 62*a* and configures a nozzle group G1, G2, and G3 with a portion forming a pair. Here, the term "forming a pair" means that these are in the same range in the sub-scanning direction. Specifically, the C nozzle row and a portion forming a pair with the C nozzle row which is a part of the K nozzle row 62*a* configure a nozzle group G1. Similarly, the M nozzle row and a portion forming a pair with the M nozzle row which is a part of the K nozzle row 62*a* configure a nozzle group G2, and the Y nozzle row and a portion forming a pair with the Y nozzle row which is a part of the K nozzle row 62*a* configure a nozzle group G3.

In the print head 62, a region (band) having a constant width on the print medium in the sub-scanning direction can be printed by each of the nozzle groups G1, G2, and G3. That is, printing using each of the nozzle groups G1, G2, and G3 is performed on one band, and thereby a color image using CMYK is completed in the one band. The width of the one band is equivalent to the length of one of the nozzle groups (the length in the sub-scanning direction).

In the print head 62, for each nozzle, a piezoelectric element for ejecting an ink droplet (dot) from the nozzle is provided. The piezoelectric element is deformed when the driving signal is applied, and ejects a dot from a corresponding nozzle. The transport mechanism 57 (FIG. 1) includes a paper feed motor and a paper feed roller which are not shown, and is driven and controlled by ASIC56, and thereby transports the print medium along the sub-scanning direction. For example, the transport mechanism 57 can transport the width of a band so as to perform printing on the same band in each of the nozzle groups G1, G2, and G3.

Driving of a carriage motor 58 is controlled to ASIC56, and thereby a carriage 60 (and the print head 62) moves along the main scanning direction, and the ASIC56 causes an ink to be discharged from each nozzle to the print head 62 at a predetermined timing along the movement. Accordingly, a dot adheres to the print medium and an image to be printed is reproduced on the print medium. The printer 50 further includes an operation panel 59. The operation panel 59 includes a display unit (for example, a liquid crystal panel), a touch panel formed in the display unit, and various buttons and keys, and receives an input from an user or displays a required UI screen on the display unit.

An array of nozzles of the print head 62 is not limited to the array illustrated in FIG. 2. For example, in the print head 62, each nozzle row of C, M, Y, and K having the same number of nozzles which are in a sub-scanning direction may be aligned in the main scanning direction. In addition, the printer 50 is not a type of a serial printer in which the print head moves in the scanning direction as described above, but may be a model (a type of a so-called line printer) where the print head where each nozzle row of C, M, Y, and K in the main scanning direction is aligned in the sub-scanning direction is fixed.

2. PRINT CONTROL PROCESSING

Figure 3:
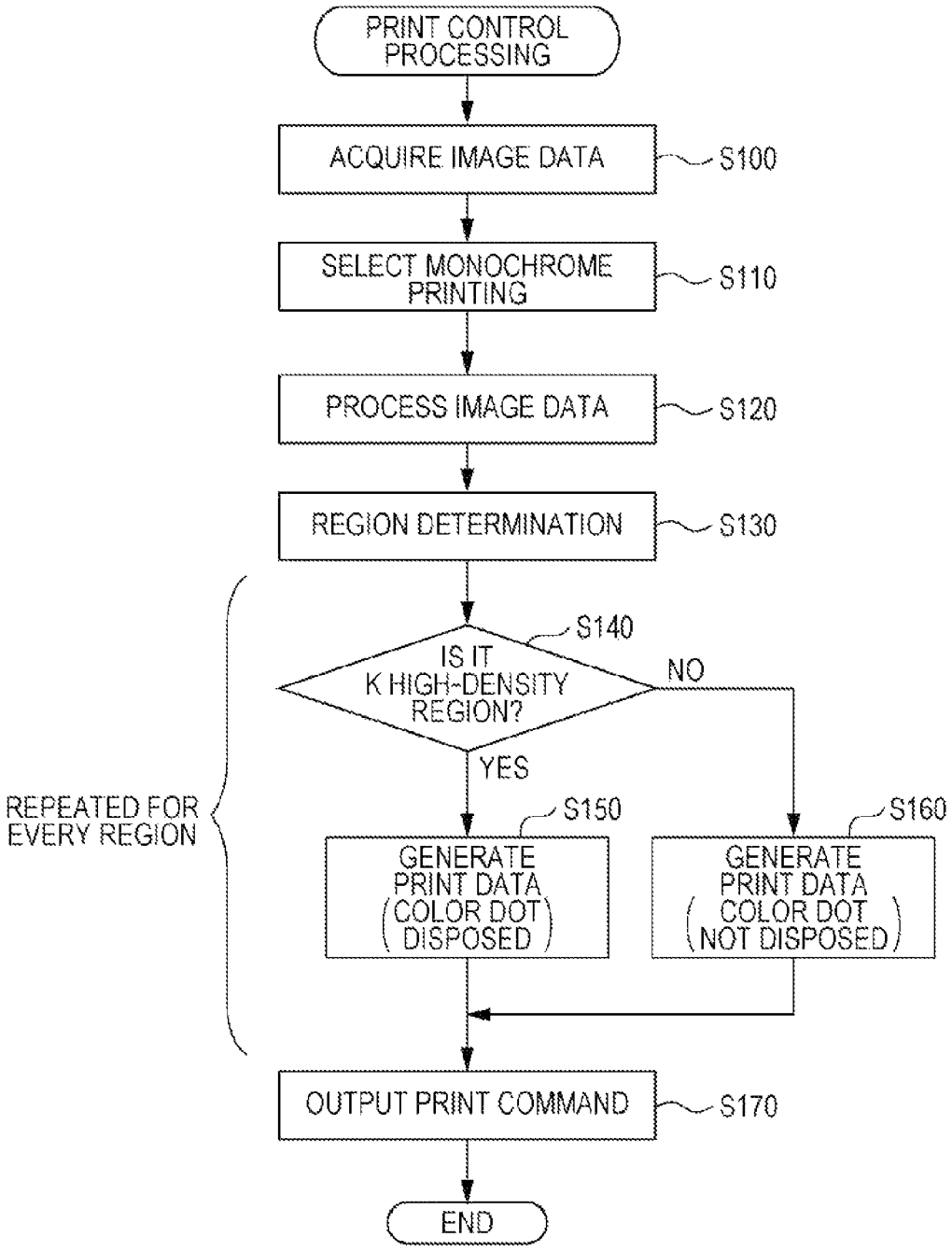
FIG. 3 is a flowchart showing print control processing.

FIG. 3 shows print control processing according to the embodiment using a flowchart. In the print control processing, a print control device which causes a monochrome image to be printed using discharge of a K ink from a nozzle discharges the chromatic color ink in addition to the K ink in a region where an amount of use of the K ink indicated by monochrome image data representing the monochrome image is equal to or higher than a predetermined threshold value.

Here, it is described that the CPU 11 performs the flowchart using the printer driver 13 (print control program). Based on the flowchart, it is assumed that a user operates the operation unit 40, and thereby any application software is activated and any image to be printed is selected.

Then, the user operates the operation unit 40 and displays a UI screen for setting a print condition on the display 30. In this state, the printer driver 13 receives the print condition. That is, the printer driver 13 receives a selection of the print conditions when causing the printer 50 to print an image to be printed according to a user input through the UI screen. Specifically, the printer driver 13 receives various print conditions such as, besides a selection of whether it is a color printing or a monochrome printing, a print mode (print speed), a type of print media, orientation of printing, assignment for a paper, necessity of two-sided printing, and the like according to a user input.

In step S100, an image data acquisition unit 13*a* receives any print executing instruction by a user, and acquires image data (hereinafter, referred to as input image data), where the image to be printed is represented, according to the print executing instruction. The input image data acquires a HDD 20, a memory card mounted on a connector for external connection which is not shown, and the like from a predetermined storage region. Here, as input image data, image data having color information for every pixel are acquired. The color information is data representing each gradation value (for example, 0 to 255 gradations) of red (R), green (G), and blue (B), for example.

In step S110, the image data processing unit 13*c* selects one of a color printing and a monochrome printing. The selection is performed along the print condition received according to a user's input through the UI screen. Here, it is assumed that the monochrome printing is selected by the user, and accordingly, in the step S110, the image data processing unit 13*c* selects the monochrome printing. Since processing where the color printing is selected and which causes an image to be printed to be color-printed by the printer 50 has been known, description thereof will be omitted in the embodiment.

In step S120, the image data processing unit 13*c* performs an image processing on input image data. The image processing performed in the step S120 means processing which includes steps until at least region determination to be described below (step S130) is executable among steps of generating print data from the input image data. For example, the image data processing unit 13*c* performs resolution conversion processing, which matches the number of pixels of the input image data to the print resolution of the printer 50, and a color conversion processing which converts the gradation (RGB value) of each pixel of the input image data to the gradation of an ink color system used by the printer 50. Here, since the monochrome printing is selected, the color conversion processing converts the gradation of each pixel of the input image data to the gradation of a K ink only, for example, a gradation which is equivalent to brightness obtained from RGB values of each pixel using a known conversion formula into the gradation of the K ink (for example, 0 to 255 gradations). Accordingly, the input image data are converted into image data having the gradation of the K ink (the amount of K ink) in each pixel.

Next, the image data processing unit 13*c* performs halftone (HT) processing on image data after the color conversion processing. The HT processing is processing which converts to image data deciding formation or non-formation of dot (dot on or dot off) in each pixel, and is performed using a dither method or an error diffusion method. Image data after the color conversion processing and image data after the HT processing are an example of the monochrome image data representing a monochrome image. Alternatively, input image data acquired by the image data acquisition unit 13*a* may be referred to as the monochrome image data representing the monochrome image.

In step S130, the region determination unit 13*b* determines the presence or absence of a region where the amount of use of the K ink indicated by the monochrome image data is equal to or higher than a predetermined threshold value (hereinafter, referred to as a K high-density region). Specifically, the region determination unit 13*b* divides monochrome image data into a plurality of regions, and directly or indirectly derives the amount of use of the K ink in each region. For example, when image data after the HI processing are set to an object of region determination, a rate of dot-on pixels in each region is calculated, and whether or not the region is the K high-density region is determined according to whether or not the rate is equal to or higher than a predetermined threshold value TH. The time when the image data after the HT processing are set to the object of region determination, at least until HT processing is included in the image processing by the step S120.

Figure 4:
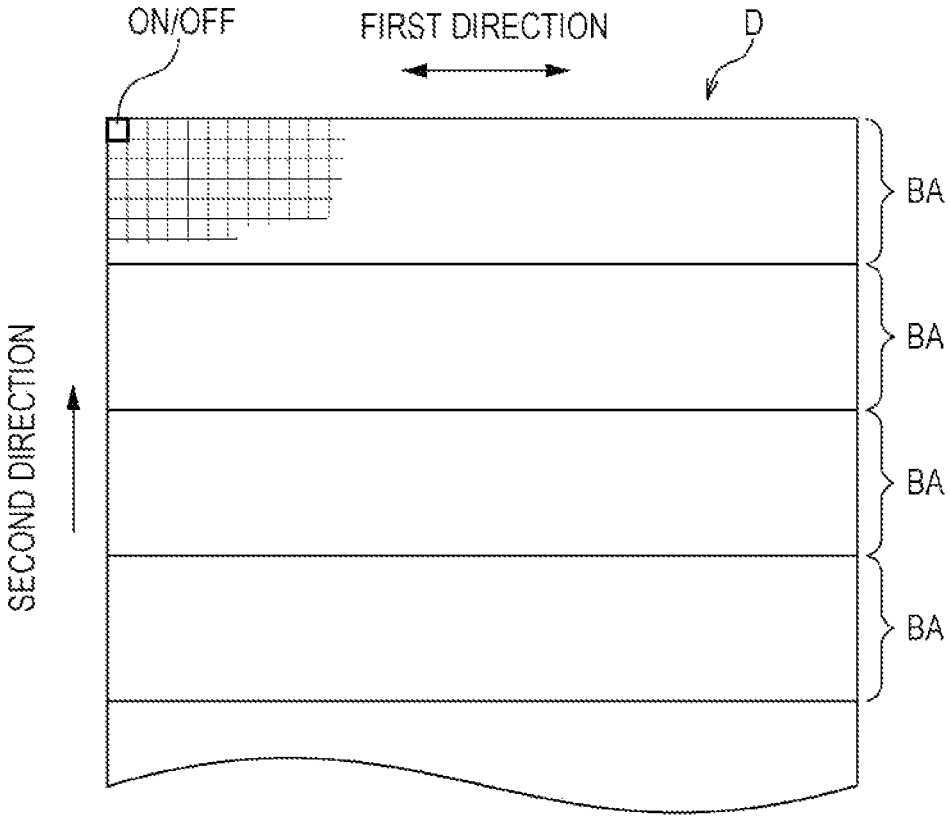
FIG. 4 is a diagram showing an example of image data after halftone processing.

FIG. 4 illustrates image data D after the HT processing. In a step S130, image data D are divided into a plurality of regions BA which have a constant width in the sub-scanning direction. When the print head 62 has a structure shown in FIG. 2, an image represented by one region BA is equivalent to an image to be printed in the above-described one band. The region determination unit 13*b* regards a region BA where the dot-on rate among the number of all pixels in the region BA (the number of dot-on pixels/the number of all pixels in a region) is equal to or higher than a threshold value TH as a K high-density region.

The region determination unit 13*b* branches processing by whether or not the region is a K high-density region for each region obtained by dividing the monochrome image data (step S140). In this case, when an object region is a K high-density region ("Yes" in step S140), the procedure proceeds to step S150, and on the other hand the procedure proceeds to step S160 when the object region is not the K high-density region ("No" in step S140). Region determination in step S130 may be performed on image data after the above-described color conversion processing. In this case, the region determination unit 13*b* compares a total value of K ink amounts of all pixels in each region with a certain threshold value to determine presence or absence of K high-density region, or compares an average value of the K ink amounts of all pixels in each region with a certain threshold value to determine presence or absence of the K high-density region. The time when the image data after the above-described color conversion processing is regarded as an object of region determination, at least until color conversion processing is included in image processing by the step S120.

In step S150, with regard to a region which is an object at that time, the image data processing unit 13*c* generates print data and the color dot control unit 13*d* performs color dot disposition processing. For example, when the color conversion processing in the step S120 is completed, the image data processing unit 13*c* performs the HT processing on the image data after the color conversion processing, and generates print data by performing rasterization processing which generates print data sorted in an order to transfer image data after HT processing to the printer 50. According to the rasterization processing, it is determined according to the pixel position at which number of times of the main scanning (path) and by which nozzle each dot defined as the image data after HT processing are formed. Alternatively, when performing until HT processing in the step S120, the image data processing unit 13*c* generates print data by performing the rasterization processing on the image data after the HT processing. The print data generated in this way are data (K ink print data) for printing an image to be printed by discharge of the K ink only.

Besides, in the color dot disposition processing in the step S150, the color dot control unit 13*d* generates chromatic color ink print data for discharging the chromatic color ink. The chromatic color ink print data are image data of the same size as a region which is an object in the step S150, and image data where dots of a plurality of chromatic color inks (C, M, Y ink) which may be discharged by the printer 50 are disposed not to overlap with each other. The chromatic color ink print data may be what dots of each chromatic color ink are regularly or irregularly disposed so as not to overlap with each other, and the number of dots in each chromatic color ink may be the same as the others or different from the others. A method of generating the chromatic color ink print data is not particularly limited. As an example, the color dot control unit 13*d* may generate the print data by applying a mask M1, M2, and M3 for disposing a color dot (hereinafter, marked as a mask M1, M2, and M3) which is stored in the HDD 20 in advance.

FIG. 5 shows an example of the mask M1, M2, and M3. Each mask is the same size having the predetermined number of horizontal and vertical pixels, and holds "0" or "1" for each pixel, respectively. A pixel position of "1" held by each mask, respectively, is different from each other, and "1" in each mask means the pixel position is dotted on. The color dot control unit 13*d* defines, for example, each of a dot disposition of the C ink by a mask 1, a dot disposition of the M ink by a mask 2, and a dot disposition of the Y ink by a mask 3, and thoroughly applies the mask M1, M2, and M3, which are superimposed without deviation, to an image region the same size as a region which is an object in the step S150. As a result, image data (chromatic color ink print data) are generated, which is the same size as a region that is an object in the step S150, and where each dot of C, M, and Y is disposed not to overlap with each other. Rasperization processing of sorting in an order to transmit to the printer 50 is also performed on the chromatic color ink print data.

In step S160, with regard to a region which is an object at that time, the image data processing unit 13*c* generates print data in the same manner as in step S150, but the color dot disposition processing by the color dot control unit 13*d* is not performed. That is, with regard to a region not corresponding to a K high-density region in the monochrome image data, only the K ink print data are generated as the print data, and the chromatic color ink print data are not generated. Steps S140 to S160 are repeatedly performed on every region which is an object of region determination (step S130). Processing until generation of the print data (K ink print data) is performed in step S120, and in step S150, the color dot disposition processing only may be performed. In this case, since a step S160 is unnecessary, the step S160 is simply skipped after branching of "No" at step S140.

In step S170, the image data processing unit 13*c* generates a print command including the print data (K ink print data, chromatic color ink print data) to send to the print command to the printer 50. The print command includes information specifying the print condition received when there is a print start instruction. As a result, the printer 50 performs printing (printing of an image to be printed under the specified print condition) based on the print command which is sent.

Figure 6:
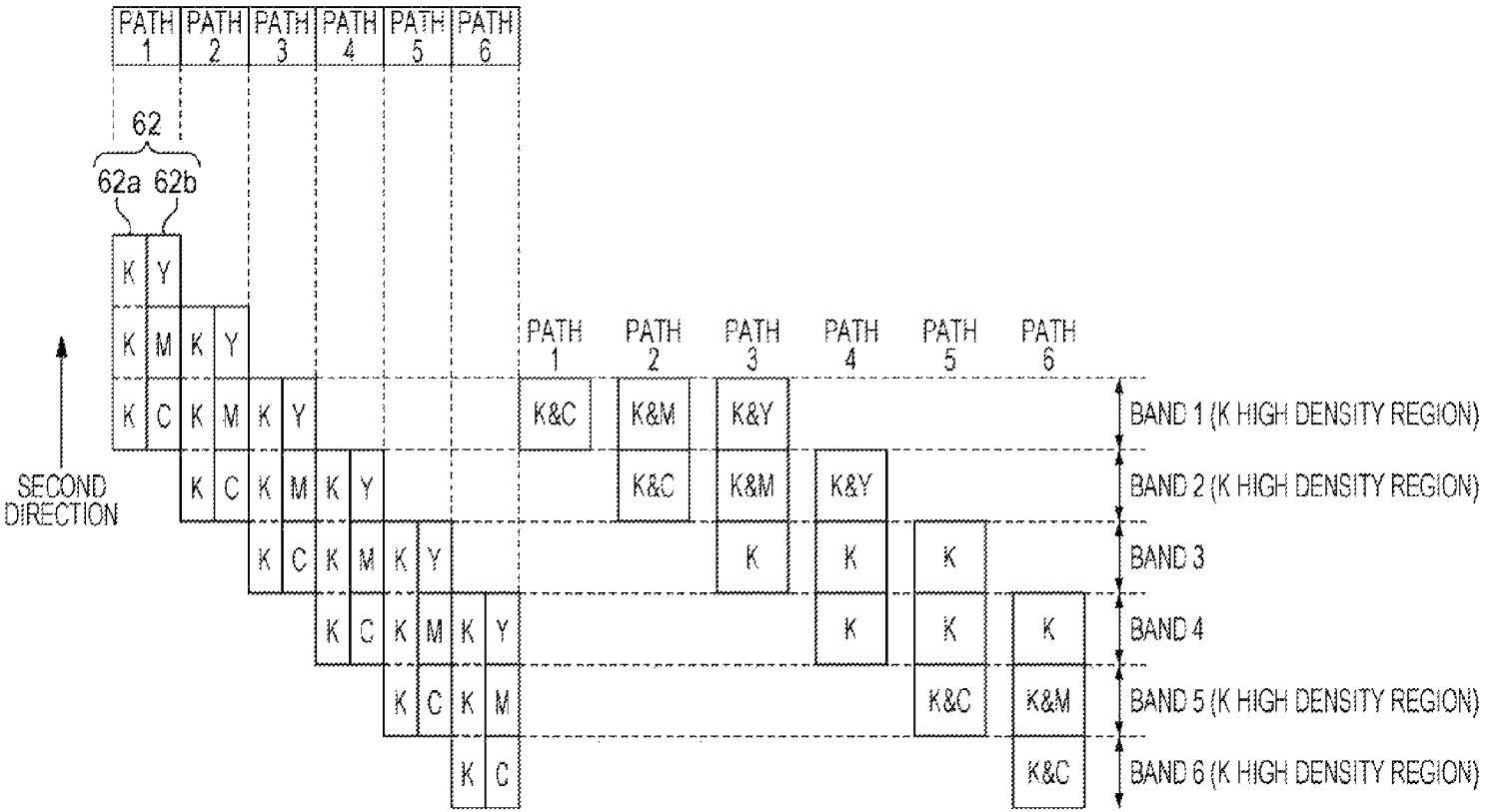
FIG. 6 is a diagram illustrating a discharge of an ink with respect to each band using each path of a print head.

FIG. 6 illustrates ink discharge to each band using each path of the print head 62 in print processing performed by the printer 50 according to a result of the flowchart of FIG. 3. In FIG. 6, on the left side, it is shown how the position of the print head 62 is changed relatively to the print medium in each path, and the total of six paths from path 1 to path 6 are shown herein. In addition, in FIG. 6, a portion (C nozzle row) attached to "C" of the chromatic nozzle row 62*b* and a portion of the K nozzle row 62*a* forming a pair with the "C" portion and attached to "K" correspond to a nozzle group G1. Similarly, a portion of "M" of the chromatic nozzle row 62*b* (M nozzle row) and a portion of the K nozzle row 62*a* forming a pair with the "M" portion and attached to "K" correspond to a nozzle group G2, and a portion of "Y" of the chromatic nozzle row 62*b* (Y nozzle row) and a portion of the K nozzle row 62*a* forming a pair with the "Y" portion and attached to the "K" correspond to a nozzle group G3.

In addition, in FIG. 6, on the right side, a position of each band (band one to six) on the print medium which is recorded using each path is illustrated. In FIG. 6, by changing a position of the print head 62 to the opposite direction of a second direction, a relative position change between the print head 62 and the print medium is illustrated. However, the print head 62 actually not only moves along a first direction, and but also moves in a second direction by the transport of the print medium as described above. Furthermore, in FIG. 6, in each path printing each band near the center, it is illustrated whether K, C, M, and Y inks are discharged or not.

In the example of FIG. 6, the bands 1, 2, 5, and 6 correspond to K high-density regions, and bands 3 and 4 do not correspond to K high-density regions. Therefore, when printing the bands 1, 2, 5, and 6, a discharge of the K ink is performed based on the K ink print data and a discharge of the C, M, and Y inks is performed based on the chromatic color ink print data. On the other hand, when printing the bands 3 and 4, a discharge of the K ink only is performed based on the K ink print data. As a result, in the print medium, a monochrome image (image to be printed) is reproduced based on the K ink print data, and each dot of the C, M, and Y inks is formed not to overlap with each other only for bands corresponding to the K high-density region. FIG. 6 shows a pattern of discharging the K ink to all of a plurality of paths (three paths) completing one band. However, by discharge of the K ink only in some paths of the plurality of paths, the monochrome image may be completed in the band.

According to the embodiment, when monochrome printing is selected by a user, the print control device performs an image formation and performs a discharge of the chromatic color ink by discharge of the K ink in a region (K high-density region) where the amount of use of the K ink is equal to or higher than a predetermined threshold value among the monochrome images indicated by the monochrome image data. Therefore, the discharged chromatic color ink is hardly noticeable on the print medium (it is hard for a user to recognize the discharged chromatic color ink). That is, it is possible to substantially eliminate the effect (a decrease in OD value) of the chromatic color ink on an image quality of a print result of the monochrome image, and to reduce a plugging of the nozzle of the chromatic color ink.

In particular, in the K high-density region reproduced to the print medium, the chromatic color inks of different colors are discharged to positions which do not overlap each other, and thereby it is possible to suppress the decrease in the OD value which is caused by an overlap between dots of the chromatic color ink, the blurring of an outline, and a deviation of hue to prevent a decrease in the image quality.

In addition, since more chromatic color ink is discharged in a region where the amount of use of the K ink is large, in a region where a so-called monochrome solid image is printed, a covering rate of the surface of the print medium by an ink is improved and the image quality is improved.

3. MODIFICATION EXAMPLE

The invention is not limited to the embodiments described above, and can be embodied in various aspects without departing from the scope and spirit thereof, and, for example, the following modification example is also possible. The content with a combination of the embodiments described above and some or all of each modification example is a disclosed scope of the invention.

Modification Example 1

A threshold value used when performing region determination (step S130 of FIG. 3) may be different with respect to at least some colors of each chromatic color ink. In other words, whether or not one region of the monochrome image data is the K high-density region can be different according to a type of the chromatic color ink to be disposed. Specifically, the threshold value can be lowered as much as a value of a chromatic color ink which has a high brightness. When comparing each ink of C, M, and Y, the height of brightness is in an order of Y, C, and M (or C and M have the same degree). Accordingly, the print control device may set relations among a threshold value TH1 of the Y ink, a threshold value TH2 of the C ink, and a threshold value TH3 of the M ink to TH1<TH2<TH3 in advance.

In this case, the region determination unit 13*b*, with regard to one region in the monochrome image data, determines that the region is the K high-density region for all of the C, M, and Y inks (hereinafter, referred to as a third K high-density region) when a dot-on rate of the K ink (a type of the amount of use of the K ink) is equal to or higher than a threshold value TH3. On the other hand, when the dot-on rate of the K ink is equal to or higher than a threshold value TH2 and less than the threshold value TH3, the region is determined to be the K high-density region for the Y and C inks (hereinafter, referred to as a second K high-density region). Similarly, when the dot-on rate of the K ink is equal to or higher than a threshold value TH1 and less than the threshold value TH2, the region is determined to be the K high-density region for the Y ink (hereinafter, referred to as a first K high-density region), and when the dot-on rate of the K ink is less than the threshold value TH1, the region is determined not to be the K high-density region for any of the chromatic color inks.

Under such a determination, in step S150, the color dot control unit 13*d* generates chromatic color ink print data where dots of the C, M, and Y inks are disposed when a region which is regarded as an object at that time is the third K high-density region. On the other hand, when the region which is regarded as an object at that time is the second K high-density region, the color dot control unit 13*d* generates chromatic color ink print data where dots of the Y and C inks are disposed, and generates chromatic color ink print data where dots of the Y ink are disposed when the region is the first K high-density region.

Figure 7:
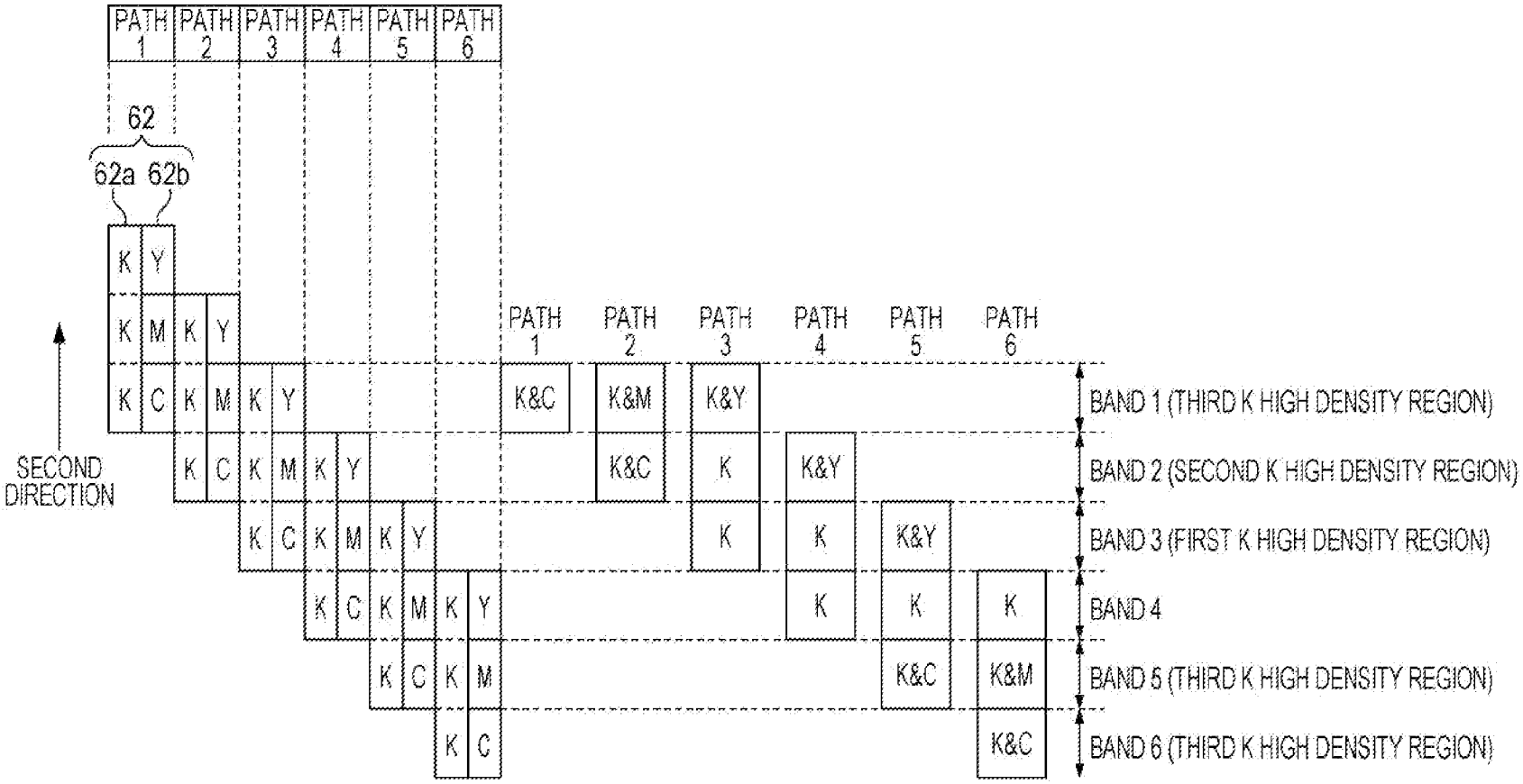
FIG. 7 is a diagram showing a discharge of an ink with respect to each band using each path of the print head according to a modification example.

FIG. 7 illustrates a discharge of an ink with respect to each band by each path of the print head 62 in print processing performed by the printer 50 according to a result of the modification example 1. A method of reading FIG. 7 is similar to that of FIG. 6. In an example of FIG. 7, bands 1, 5, and 6 correspond to the third K high-density region, a band 2 corresponds to the second K high-density region, a band 3 corresponds to the first K high-density region, and a band 4 does not correspond to any of the K high-density regions. Therefore, when printing the bands 1, 5, and 6, a discharge of the K ink is performed based on the K ink print data and a discharge of the C, M, and Y inks is performed based on the chromatic color ink print data. In addition, when printing the band 2, a discharge of the K ink is performed based on the K ink print data and a discharge of the C and Y inks is performed based on the chromatic color ink print data. In addition, when printing the band 3, a discharge of the K ink is performed based on the K ink print data and a discharge of the Y ink is performed based on the chromatic color ink print data. Then, when printing the band 4, a discharge of only the K ink is performed based on the K ink print data.

In the modification example 1, determination criteria to determine whether to form dots of the chromatic color ink and dots of the K ink (a density of a black ink (the amount of use of the K ink) in each region of the monochrome image data) is different according to a type of an ink. That is, the threshold value is set according to intensity of the effect of each chromatic color ink on an appearance of the print result (the level of brightness). A chromatic color ink which has a relatively high brightness (a chromatic color ink whose dot is unlikely to be noticed) is discharged with the black ink even in a region where the amount of use of the K ink is relatively low, and a chromatic color ink which has a low brightness (a chromatic color ink whose dot is likely to be noticed) is discharged with the black ink in a region where the amount of use of the K ink is relatively high. Therefore, it is possible to realize a good balance between the ensuring of a quality of the print result of the monochrome image and the suppressing of the plugging of a nozzle of the chromatic color ink. Considering that the C and the M ink have the same brightness, relations of the threshold values TH1, TH2, and TH3 may be set to TH1<TH2=TH3.

Modification Example 2

Figure 8:
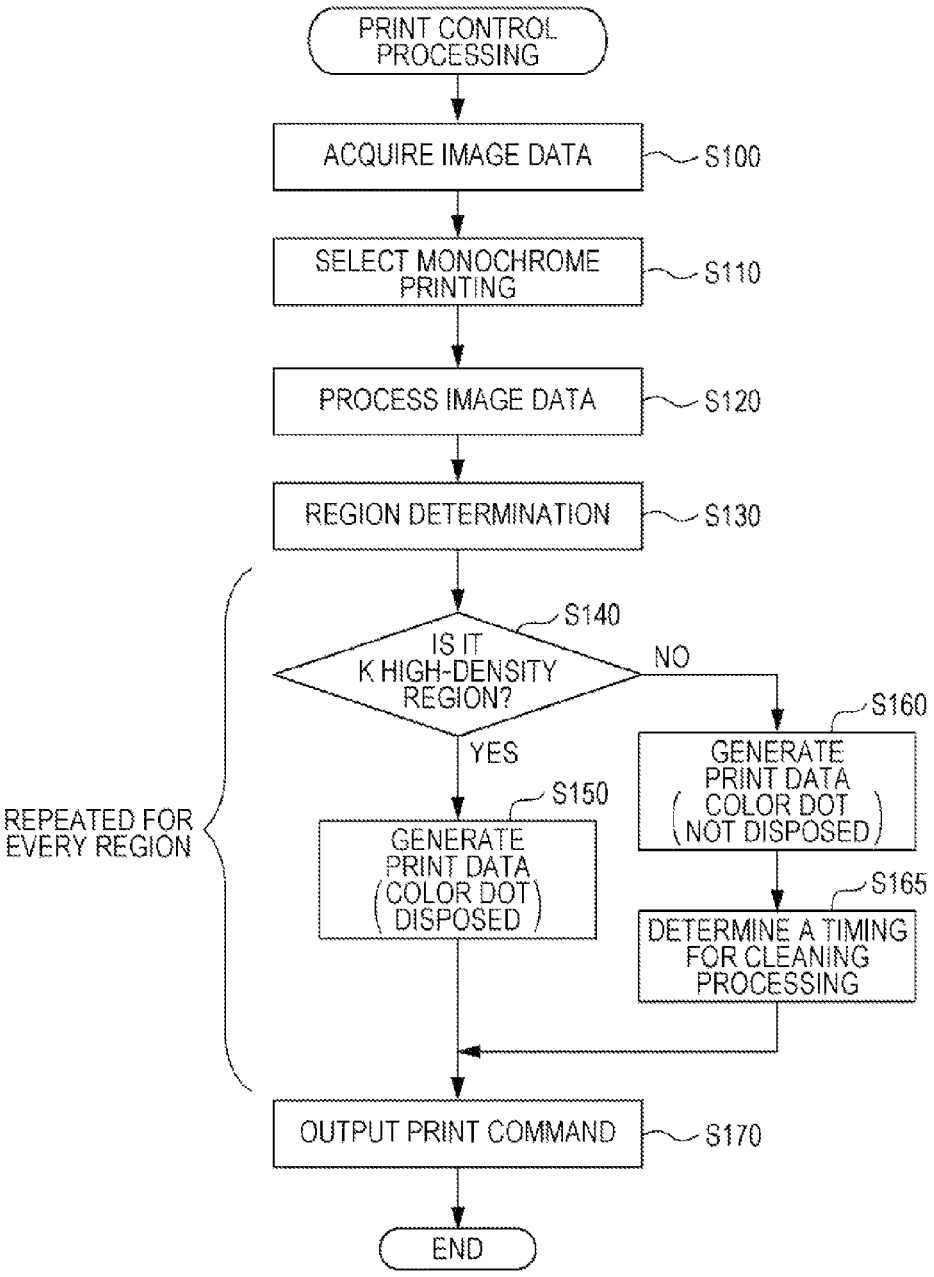
FIG. 8 is a flowchart showing print control processing according to the modification example.

FIG. 8 shows print control processing according to a modification example 2 using a flowchart. FIG. 8, when compared with FIG. 3, is different in having step S165. In the step S165, the printer driver 13 determines a timing of cleaning processing for the nozzle of the chromatic color ink to be performed after the discharge of the K ink to a region where the amount of use of the K ink indicated by the monochrome image data does not reach the threshold value. The cleaning processing means, when the print head 62 moves to a position deviated from the print medium, processing which discharges an ink to a waste cap disposed at the position to prevent the plugging of the nozzle. The cleaning processing of the nozzle is referred to as flushing. The printer 50 is a model which may perform the cleaning processing for each nozzle row (K nozzle row, C nozzle row, M nozzle row, and Y nozzle row).

For example, when performing description referring to FIG. 6, the printer driver 13 determines that the C nozzle row after the end of a path 3, the C nozzle row and the M nozzle row after the end of a path 4, the M nozzle row and the Y nozzle row after the end of a path 5, and the Y nozzle row after the end of a path 6 perform the cleaning processing, respectively. In addition, when describing referring to FIG. 7, the printer driver 13 determines that the C nozzle row and the M nozzle row after the end of the path 3, the C nozzle row and the M nozzle row after the end of the path 4, the M nozzle row after the end of the path 5, and the Y nozzle row after the end of the path 6 perform the cleaning processing, respectively. Information on such determinations (information on the timing of the cleaning processing) is included in the print command, and sent to the printer 50. The printer 50 performs the cleaning processing at a timing according to the information on the timing of the cleaning processing.

That is, the printer 50, at a timing after the nozzle rows of the chromatic color ink pass through a band corresponding to a region which is not the K high-density region (a region where a discharge of the chromatic color ink is not performed based on the chromatic color ink print data), performs the cleaning processing on the nozzle rows of the chromatic color ink which have passed through the band. As a result, when performing a monochrome printing, by combining with a discharge of the chromatic color ink based on the chromatic color ink print data, it is possible to suppress the plugging of the nozzle of the chromatic color ink the most. Each nozzle row of the chromatic color ink may not be an object of the cleaning processing whenever passing through a band corresponding to a region which is not the K high-density region, but be an object of the cleaning processing at a rate of once in a plurality of times of passing through a band corresponding to a region which is not the K high-density region. By reducing the number of times of the cleaning processing as much as possible, it is possible to improve the throughput of printing, to suppress ink consumption, and to reduce the number of times of maintenance for the waste cap.

Modification Example 3

As one of the methods that make dots of the chromatic color ink which are discharged to the print medium for the purpose of preventing the plugging of the nozzle unnoticeable, the printer driver 13 may discharge the chromatic color ink prior to the K ink when discharging the chromatic color ink to the K high-density region. That is, in a band corresponding to the K high-density region, the chromatic color ink first lands on the print medium so as to cause the K ink to land thereon.

Figure 9A:
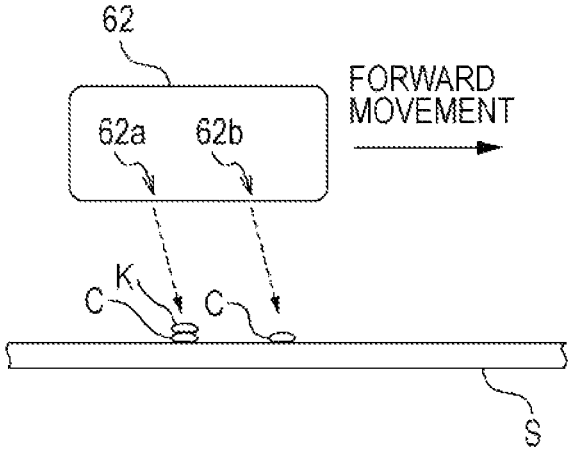
FIGS. 9A and 9B are diagrams showing relations between a moving direction of the print head and a landing order of dots.
Figure 9B:
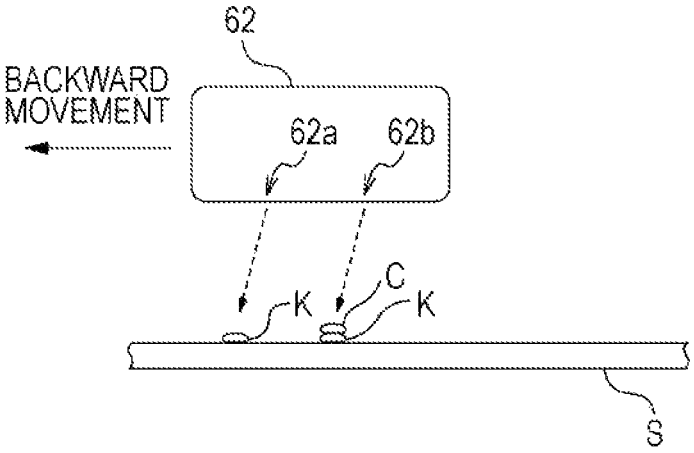

FIGS. 9A and 9B are diagrams showing relations between a moving direction of the print head 62 and a landing order of dots, and show positional relations between the print head 62 and the print medium S from a view point in a transport direction of the print medium. FIG. 9A shows how a dot is discharged from a K nozzle row 62*a* and a chromatic nozzle row 62*b* to a print medium S when the main scanning of the print head 62 moves forward. According to an example of FIG. 9A, since the chromatic nozzle row 62*b* is positioned ahead of the K nozzle row 62*a* in a moving direction, a dot of the chromatic color ink (for example, C ink) is landed on the print medium first to cause a dot of the K ink to be landed thereon. On the other hand, FIG. 9B shows how a dot is discharged from the K nozzle row 62*a* and the chromatic nozzle row 62*b* to the print medium S when the main scanning of the print head 62 moves backward. According to an example of FIG. 9B, since the chromatic nozzle row 62*b* is positioned behind the K nozzle row 62*a* in the moving direction, the dot of the K ink is landed on the print medium S first to cause the dot of the chromatic color ink (for example, C ink) to be landed thereon.

As in an example of FIGS. 9A and 9B, when the print head 62 performs an ink discharge in each of the forward movement and the backward movement, the printer driver 13 discharges the chromatic color ink and the K ink to the K high-density region in the forward movement. Accordingly, the chromatic color ink is landed on the print medium first and the K ink covers the print medium, so that it is possible to substantially eliminate the effect of the chromatic color ink on the image quality of the monochrome image. However, a specific method of causing the chromatic color ink to be landed prior to the K ink is not limited to the method described above. For example, in a path except for the last path among a plurality of paths completing one band corresponding to the K high-density region, a discharge of the K ink is regarded to be zero while discharging the chromatic color ink. Then, in the last path, a discharge of the chromatic color ink (the first in a landing order) and a discharge of all of the K ink (the next in the landing order) which is necessary for the completion of the band may be performed.

Modification Example 4

As described above, the array of the nozzles of the print head 62 may be an array in which each nozzle row of C, M, Y, and K having the same number of nozzles facing the sub-scanning direction is aligned in the main scanning direction. When adopting the array, the width of the band is equivalent to the length of the nozzle row, for example, and one region of monochrome image data is equivalent to an image printed on one band. In addition, the number of paths needed to complete one band may not be particularly limited in a case of adopting the array illustrated in FIG. 2 or in a case of not adopting the array, and may be three or any other number except three.

Modification Example 5

As described above, the print head 62 may have a configuration (print head of a so-called line printer) where each nozzle row of the C, M, Y, and K facing the main scanning direction is aligned and fixed in the sub-scanning direction. When adopting the array, the monochrome image data may be divided into a plurality of monochrome image data in the sub-scanning direction, and thereby each of the regions may be obtained, or an entire image may be one region. In addition, when there is a region which does not correspond to the K high-density region in the monochrome image data, the printer driver 13 performs the cleaning processing on the chromatic nozzle row (each nozzle row of C, M, and Y) after a printing of one page.

Modification Example 6

A case where the computer 10 performs print control processing is described as an example above. However, the print control processing may be performed in the printer 50. That is, the CPU 51 of the printer 50 performs the firmware FW (print control program), and thereby each above-described function of the image data acquisition unit 13*a*, the region determination unit 13*b*, the image data processing unit 13*c*, and the color dot control unit 13*d* may be performed in the printer 50 and the flowcharts of FIGS. 3 and 8 may be performed. In addition, in this case, the masks M1, M2, and M3 may be stored in a memory such as the ROM 53 in the printer 50. In addition, the CPU 51 receives a print condition for an image to be printed, an operation for instructing a print start, and the like from a user through an operation panel 59. Alternatively, the flowchart of FIGS. 3 and 8 may be shared by the printer driver 13 and the firmware FW to be realized.

The entire disclosure of Japanese Patent Application No. 2012-252968, filed Nov. 19, 2012 is expressly incorporated by reference herein.

What is claimed is:

1. A print control device which causes a monochrome image to be printed by discharge of a black ink from a nozzle for discharging an ink, the control device comprising a region determining unit for determining a plurality of regions of an image, each region having a number of pixels, wherein a chromatic color ink in addition to black ink is discharged in the plurality of regions where an amount of use of the black ink indicated by the monochrome image data representing the monochrome image is equal to or higher than a predetermined threshold value and only black ink is discharged in the regions where an amount of use of the black ink indicated by the monochrome image data representing the monochrome image is less than a predetermined threshold and wherein the regions are determined by calculating a number of dot-on pixels compared to the number of pixels in a region.

2. The print control device according to claim 1, wherein chromatic color inks of different colors are discharged to positions which do not overlap each other in the regions.

3. The print control device according to claim 1, wherein the threshold value varies with respect to at least a part of the chromatic color ink of different colors.

4. The print control device according to claim 3, wherein the higher a brightness value of the chromatic color ink is, the lower the threshold value is.

5. The print control device according to claim 1, wherein the chromatic color ink is discharged prior to the black ink in the regions.

6. The print control device according to claim 1, wherein, after discharging a black ink in a region where the amount of use of the black ink indicated by the monochrome image data does not reach the threshold value, cleaning processing is performed which discharges the chromatic color ink to a position deviated from a print medium.

7. A print control method which causes a monochrome image to be printed by discharge of a black ink from a nozzle for discharging an ink, wherein a chromatic color ink in addition to the black ink is discharged in a regions where an amount of use of the black ink indicated by monochrome image data representing the monochrome image is equal to or higher than a predetermined threshold value and wherein a control device comprising a region determining unit determine the plurality of regions of an image and wherein only black ink is discharged in the regions where an amount of use of the black ink indicated by the monochrome image data representing the monochrome image is less than a predetermined threshold and wherein the regions are determined by calculating a number of dot-on pixels compared to the number of pixels in a region.

8. A recording medium, having a program for causing a computer to realize a processing that prints a monochrome image by discharge of a black ink from a nozzle for discharging an ink, wherein a chromatic color ink in addition to the black ink is discharged in a regions where an amount of use of the black ink indicated by monochrome image data representing the monochrome image is equal to or higher than a predetermined threshold value and wherein a control device comprising a region determining unit determine the plurality of regions of an image and wherein only black ink is discharged in the regions where an amount of use of the black ink indicated by the monochrome image data representing the monochrome image is less than a predetermined threshold and wherein the regions are determined by calculating a number of dot-on pixels compared to the number of pixels in a region.

* * * * *